US005577727A

United States Patent [19]

Brame et al.

[11] Patent Number: 5,577,727

[45] Date of Patent: Nov. 26, 1996

[54] INSTANTANEOUS BINGO TRACKING METHOD AND APPARATUS

[75] Inventors: Ian G. Brame, Lancashire; Raymond K. Latham, Farnworth Bolton, both of England

[73] Assignee: Europrint Holding, Ltd., Blackburn, England

[21] Appl. No.: 310,948

[22] Filed: Sep. 23, 1994

[51] Int. Cl.[6] ..... A63F 3/06

[52] U.S. Cl. ..... 273/139; 273/269; 273/148 R

[58] Field of Search ..... 273/269, 148 R, 273/139; 283/48.1, 49

[56] References Cited

U.S. PATENT DOCUMENTS

| | | | |
|---|---|---|---|
| 4,747,600 | 5/1988 | Richardson et al. | 273/269 |
| 4,909,516 | 3/1990 | Kolinsky | 273/269 |
| 5,072,381 | 12/1991 | Richardson et al. | 273/269 |
| 5,158,293 | 10/1992 | Mullins | 273/139 |
| 5,351,970 | 10/1994 | Fioretti | 273/439 |

*Primary Examiner*—Jessica J. Harrison

*Attorney, Agent, or Firm*—Marshall, O'Toole, Gerstein, Murray & Borun

[57] ABSTRACT

A method of determining whether a winning entry exists in a bingo game with a large number of entrants includes providing entry cards where the spaces on the cards containing numbers are divided into two or more groups. The symbols in the spaces of a group are arranged in patterns and patterns appear on more than one entry card. As numbers are selected as winning numbers in the bingo game, they are compared with a map of all patterns. If winning patterns are found to exist, the set of winning patterns is compared to a group map which lists all the combinations of patterns which exist to form entry cards. If a card exists with more than one group with winning patterns, a winning card exists and no more winning numbers need be selected.

19 Claims, 5 Drawing Sheets

FIG. 5

80

| I | | II | | |
|---|---|---|---|---|
| 2 | 17 | 33 | 46 | 63 |
| 6 | 19 | 34 | 56 | 66 |
| 10 | 22 | 37 | 57 | 69 |
| 12 | 27 | 41 | 58 | 73 |
| 15 | 28 | 45 | 60 | 74 |
| 12 | 14 | 16 | 18 | 20 |

FIG. 6

90

| I | | II | | |
|---|---|---|---|---|
| 1 | 16 | 33 | 46 | 63 |
| 5 | 19 | 34 | 56 | 66 |
| 9 | 23 | 37 | 57 | 69 |
| 10 | 27 | 41 | 58 | 73 |
| 13 | 29 | 45 | 60 | 74 |
| 12 | 14 | 16 | 18 | 20 |

INSTANTANEOUS BINGO TRACKING METHOD AND APPARATUS

BACKGROUND OF THE INVENTION

1. Field of Invention

The present invention relates generally to bingo or other games in which a winning entry consists of a card having an arrangement of symbols which matches a set of selected winning symbols and more particularly to a method and apparatus for determining whether a sufficient number of winning symbols have been selected so that a winning entry exists.

2. Background Art

Conventional bingo games are played using a set of preprinted cards having a number of columns (usually five) with each column having a number of spaces (usually five). Each of the spaces on the cards contains a symbol, usually a number and/or a letter and the cards are printed in such a fashion that no two cards have the same symbols or the same pattern of symbols arranged on the cards. Once the cards have been distributed to players, symbols are selected until all of the symbols on one of the cards have been selected and the player having that winning card calls out "Bingo." At that point, no additional symbols are drawn and the winning card holder receives a payment or other prize.

One disadvantage of conventional bingo games is that all contestants must usually be in the same room so that they can call out "Bingo" when all of the symbols on one of their cards have been selected. This requirement has prevented bingo from being used on a large scale basis, such as in lotteries where millions of participants are informed of winning numbers by radio or television. There is no practical mechanism in such a situation for a winning ticket holder to inform the individuals running the game that there is no need to draw additional numbers. One possible solution to the need to stop drawing numbers is to create a database of all bingo cards sold and track winning cards by comparing that database to the selected numbers as they are drawn. However, such tracking has heretofore required a huge database and a massive amount of computing time, even on the most advanced computer, in order to compare the database to every number selected. Decreasing the length of time to effect the comparisons is extremely important, since a number cannot be drawn until a comparison has been made for all previous numbers. Long delays in making the comparisons would increase the cost to televise a drawing, would detract from the suspense of the game, and, under some game designs, make it entirely impractical.

SUMMARY OF THE INVENTION

In accordance with the present invention, a method for determining if a winning entry exists includes creating entry cards having a plurality of spaces. Each space contains one of a variety of symbols and the spaces are arranged in first and second groups. The symbols in the spaces of the first group on the cards form a first plurality of patterns and at least one of the patterns in the first plurality appears on more than one card. The symbols in the spaces of the second group on the cards form a second plurality of patterns and a winning card is a card having a first group with a winning pattern and a second group with a winning pattern.

First and second maps of all patterns in the first and second groups, respectively, are created, and a fourth map correlating which patterns in the first group appear on cards with which patterns in the second group may be created. A series of winning symbols is selected and a third map is created of the winning symbols. The first map is compared to the third map to determine whether any patterns in the first group are winning patterns. The second map is compared to the third map to determine whether any patterns in the second group are winning patterns. The fourth map may be compared to the winning patterns in the first group and the winning patterns in the second group to determine if there are any winning cards.

In accordance with another aspect of the present invention, the patterns in the second group may appear on more than one entry card.

In accordance with other aspects of the present invention, the second map may be compared to the third map, only if there are winning patterns in the first group. The third map may be compared to the winning patterns in the first group and the winning patterns in the second group only if there are winning patterns in the second group. Another symbol may be selected and added to the map if there are no winning patterns in the first group, no winning patterns in the second group or no winning cards. The symbols may comprise numbers or letters.

The cards may have columns of spaces where the first group comprises a first column and the second group comprises a second column. A winning first group may have symbols in the first column that have been selected as winning symbols and a winning second group may have symbols in the second column that have been selected as winning symbols.

The cards may have five columns of spaces and the first group may have a first column and a second column and the second group may have a third column, a fourth column and a fifth column. A winning first group may have only symbols in the first column and the second column that have been selected as winning symbols and a winning second group may have only symbols in the third column, the fourth column and the fifth column that have been selected as winning symbols.

The space of the entry cards may be arranged in three or more groups and a winning entry card may have three or more groups with winning patterns. A winning pattern may be a pattern with only symbols in that pattern that have been selected as winning symbols. In accordance with another aspect of the present invention, means are provided for carrying out the method for determining if a winning entry exists.

BRIEF DESCRIPTION OF THE DRAWINGS

Other features and advantages of the invention will be apparent from the following description taken in connection with the drawings wherein:

FIG. 5 is a plan view of an entry card having numerals in the spaces of the cards;

FIG. 6 is a plan view of an entry card having numerals in the spaces of the card.

DETAILED DESCRIPTION

Figure 3:
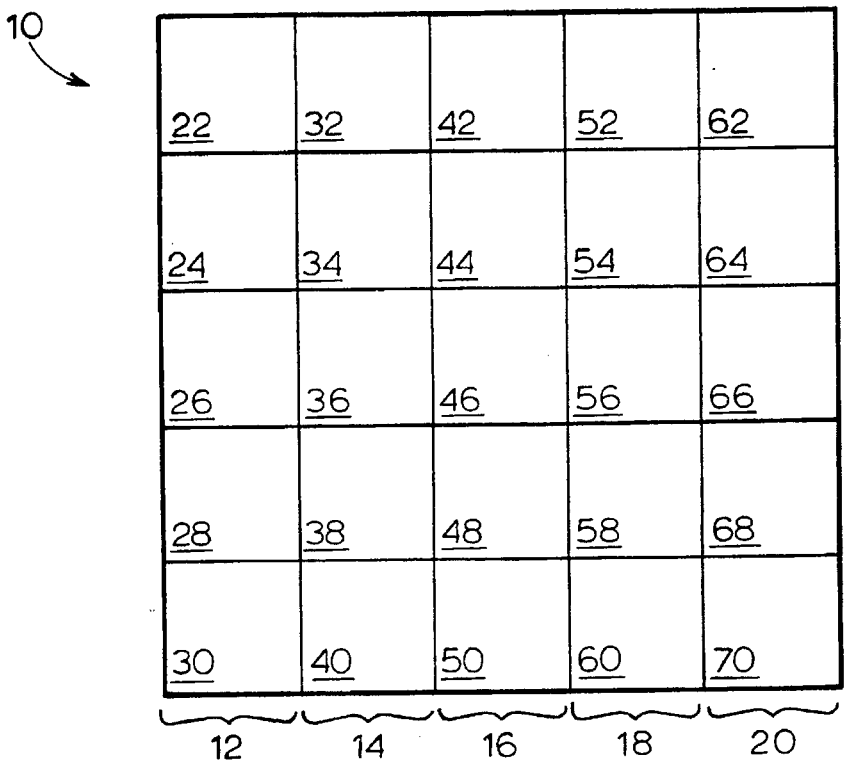
FIG. 3 is a plan view of an entry card used with the method of the present invention.

Referring initially to FIG. 3, a bingo entry card indicated generally at 10 has columns 12, 14, 16, 18 and 20. Each column contains five spaces so that the column 12 has spaces 22, 24, 26, 28 and 30, the column 14 has spaces 32, 34, 36, 38 and 40, the column 16 has spaces 42, 44, 46, 48 and 50, the column 18 has spaces 52, 54, 56, 58 and 60, and the column 20 has spaces 62, 64, 66, 68 and 70. Each of the spaces will have a symbol, generally a number or a letter printed therein, as will be described more fully below.

Figure 4:
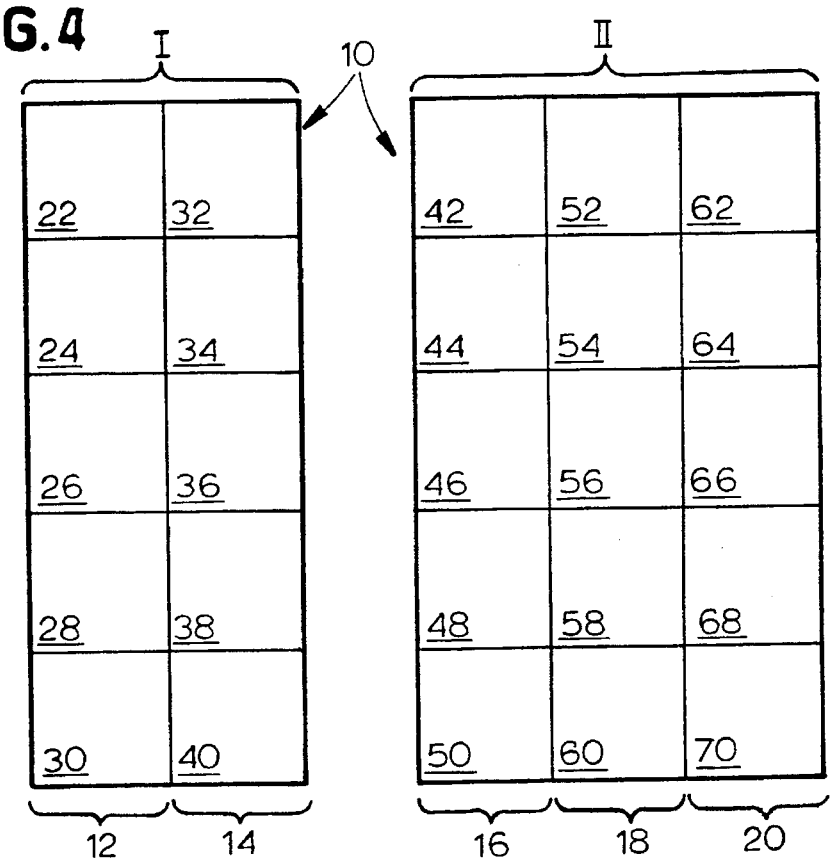
FIG. 4 is a plan view of the entry card of FIG. 3 shown with columns divided into two groups.

FIG. 4 graphically depicts the entry card 10 where the spaces have been divided into two groups: group I including columns 12 and 14 and group II including columns 16, 18 and 20. In this instance, the entry card 10 has been divided for convenience into groups consisting of complete columns; however, the groups could be divided into complete rows, a mixture of complete or partial rows or columns or any other division of spaces.

Figure 1:
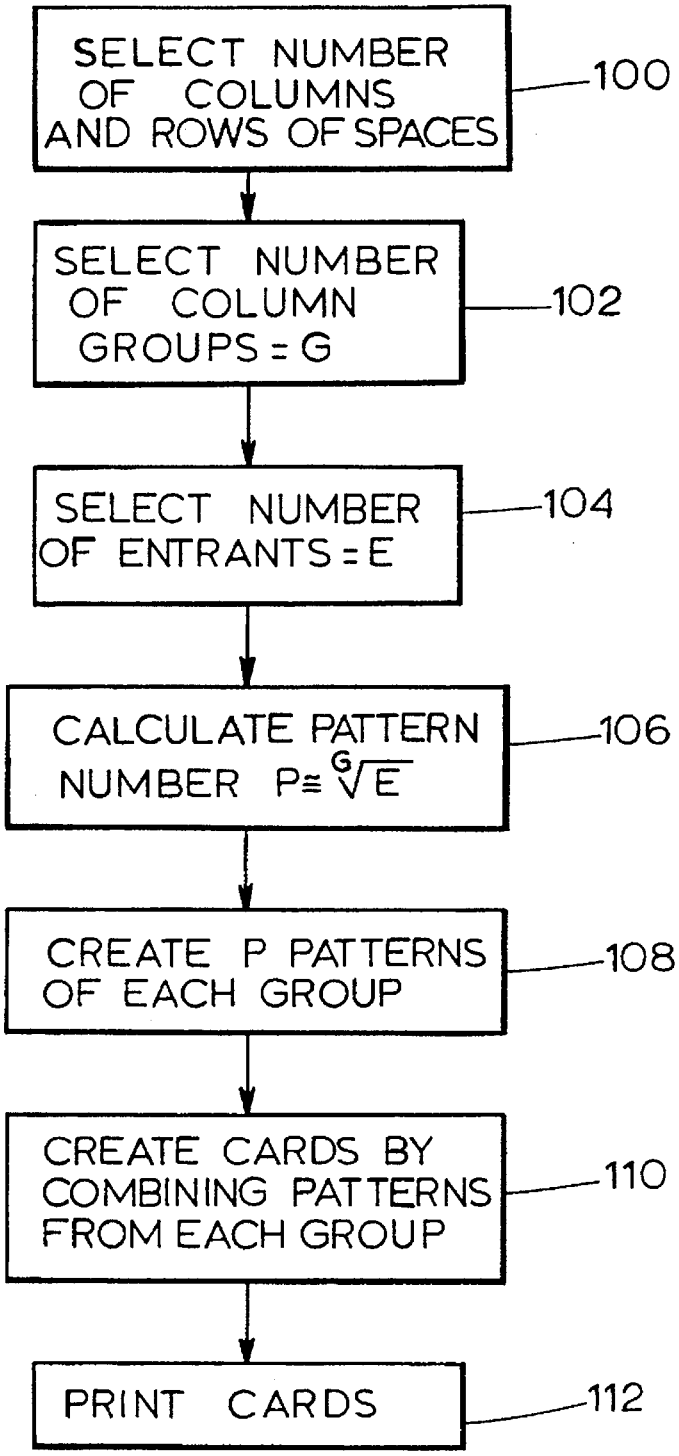
FIG. 1 is a block diagram of a method for creating entry cards for use with the present invention.

Referring now to FIG. 1, a method for creating entry cards begins at a block 100 with the selection of the number of columns and rows of spaces. Conventional bingo games generally have five columns and five rows of spaces, but any number of rows and columns may be used, and under some game configurations, the spaces could be placed in an arrangement which does not have rows or columns. Control then passes to block 102 where the number of groups of spaces, G, is selected. It will generally be desirable to have a small number of groups, but in no event can there be less than two groups. When the number of groups has been selected, the spaces of an entry card should be assigned to the various groups as was shown above for entry card 10. It will generally be desirable to assign similar numbers of spaces to each group, but it is not necessary. All entry cards will have the same configuration of spaces and the corresponding spaces on every card will usually be assigned to the same groups. It is possible to assign spaces on different subsets of cards to different sets of groups when there are a large number of entry cards.

Control next passes to block 104 to determine the number of entrants or entry cards E which will be created for the game. The number of entry cards will generally be determined by the number of players expected to purchase or otherwise obtain cards. Control then passes to a block 106, where a pattern number P is calculated approximately equal to the G'th root of E. If there are only two groups G, the pattern number will be approximately equal to the square root of E. If the cards have been divided into two subsets, each with different sets of groups, the number of patterns for each subset of groups will be approximately equal to the G'th root of (E/C) where C is the number of subsets.

Examples of patterns are shown in FIGS. 5 and 6 for entry cards 80 and 90, respectively. Each entry card 80, 90 consists of a group I having the spaces in the columns 12 and 14 and a group II having the spaces in the columns 16, 18 and 20. The pattern for group I on the entry card 80 is the numbers "2, 6, 10, 12, 15, 17, 19, 22, 27, 28." The entry card 90 has a different pattern for group I consisting of the numbers "1, 5, 9, 10, 13, 16, 19, 23, 27, 29." Group II of the entry cards 80, 90 have the identical pattern "33, 34, 37, 41, 45, 46, 56, 57, 58, 60, 63, 66, 69, 73, 74." The entry card 80 and the entry card 90 therefore have the same pattern in group II but are different cards, since their patterns in group I are different. Each different pattern for group I can be combined with each pattern of group II to form a set of entry cards. For instance, if 100 group I patterns and 100 group II patterns have been created, they can be arranged to produce 100×100=10,000 unique entry cards. Similarly, if there are to be 10,000 entrants in a game which will have two groups on a card, the square root of 10,000=100 patterns for each group must be created so that each entrant will have a unique card. If unique cards are not required, then fewer of the G'th root of E patterns may be created.

Returning to FIG. 1, control now passes to a block 108 for the creation of P patterns in each group. Creating the patterns can be accomplished randomly or symbols can be assigned in whole or in part by an individual. For instance, in the entry card 80 and the entry card 90, only the numbers 1–15 appear in the column 12, only the numbers 16–30 appear in the column 14, only the numbers 31–45 appear in the column 16, only the numbers 46–60 appear in column 18 and only the numbers 61–75 appear in column 20, as is customary in bingo. However, the symbols can be arranged in any fashion within the patterns. In addition, it is not necessary for there to be an identical number of patterns in each group, but it may be advantageous and make tracking of patterns more efficient. In fact, when the G'th root of E is not an integer, it may be desirable to create groups with different numbers and patterns. For instance, if there are to be 2000 entrants in a two-group game, P equals 44.7, which is approximately equal to 45. Thus 45 patterns can be created for each group or 40 patterns could be created for group I and 50 patterns for group II to produce 40×50=2000 unique cards.

Control then passes to a block 110 where entry cards are created by combining patterns from each group. The cards are then printed at a block 112. Printing cards may be accomplished in the conventional fashion by physically placing symbols on a sheet of paper. It is also possible to print the numbers electronically by transmitting them to a player. In any event, it is important that the arrangement of the symbols on a card be transmitted in some form to a player. Since, as described below, the present invention permits the use of bingo on a large scale, cards may be printed on conventional lottery machines and distributed like other lottery tickets.

Figure 2:
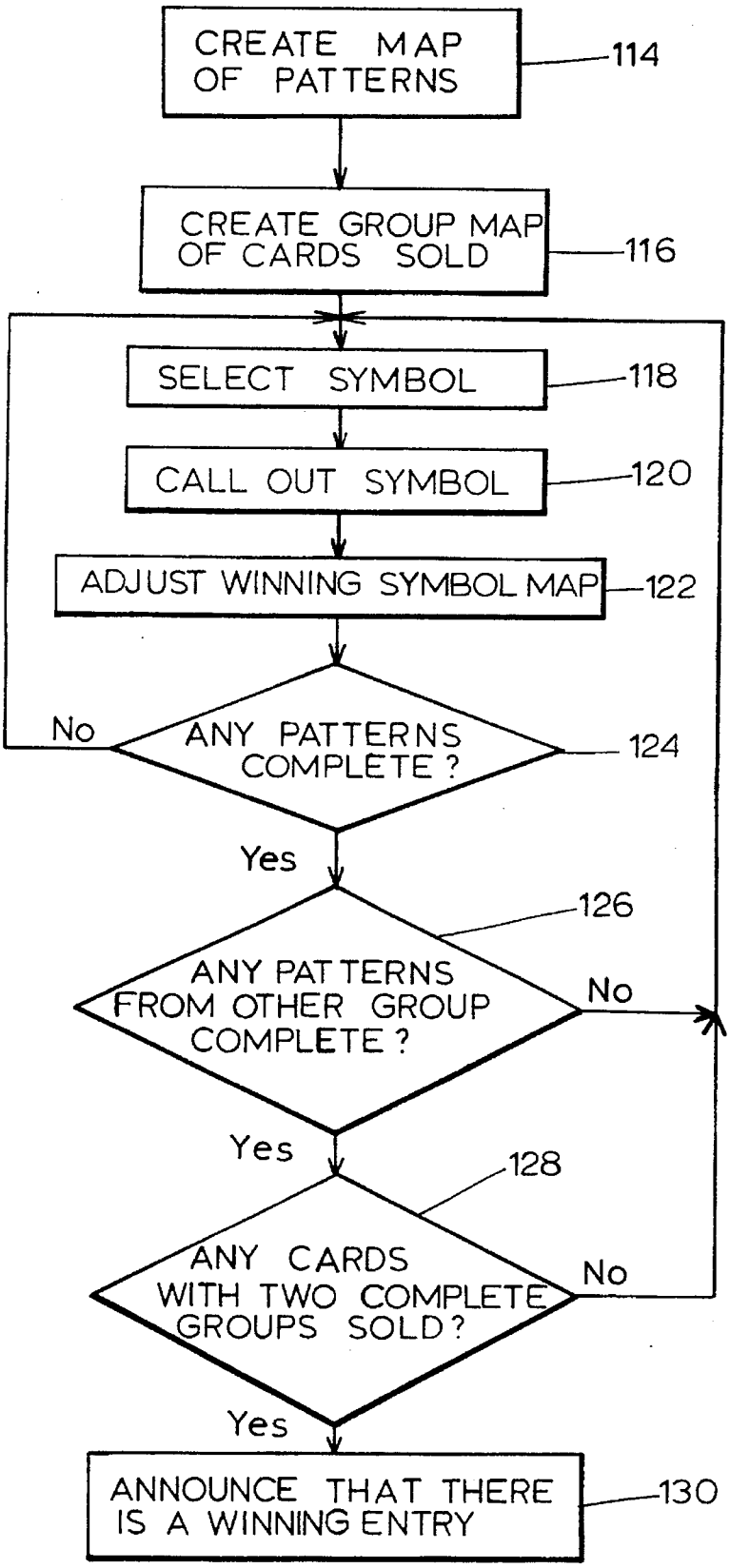
FIG. 2 is a block diagram of a method, in accordance with the present invention, of determining when a winning ticket exists.

FIG. 2 describes the process for determining when a winning entry card exists as numbers or other symbols are selected for a bingo game. At a block 114 a map of all patterns is created, and at a block 116 a group map of cards sold, created or distributed is created. It will likely be most convenient to create these maps in the form of databases on a computer, but if there are a relatively small number of entry cards, it may be feasible to map the patterns on a written grid. The map of patterns will consist of a list of all symbols in that pattern and may, in fact, be a plurality of maps equal to the number of groups that the entry cards have. For instance, the pattern for group I of the entry card 80 might be entered on a map as "2, 6, 10, 12, 15, 17, 19, 22, 27, 28," and the pattern of group II of the entry card 80 might be entered on a second map as "33, 34, 37, 41, 45, 46, 56, 57, 58, 60, 63, 66, 69, 73, 74." The group I entry might also be given the letter "A" to designate its pattern, and group II the of entry card 80 might be given the letter "B" to designate its pattern. The group map would then contain the entry "AB" to designate that an entry card exists which is a combination of pattern A and pattern B. The pattern for group I of the card 90 might be entered on the first map as "1, 5, 9, 10, 13, 16, 19, 23, 27, 29," and be given the letter "C" to designate that pattern. The group map would then contain the entry "CB" to designate that an entry card having the pattern C and the pattern B existed.

The creation of the pattern map or maps and the group map need not be undertaken after the cards are printed, and in fact, it may be convenient to create those maps in conjunction with the creation of the patterns in the block 108 and the creation of cards by combining patterns in the block 110. At whatever time the maps are constructed it is important that once the selection of the numbers for the bingo game begins, the maps only contain patterns and groups which are in use on player's cards. This may require some mechanism to delete patterns or groups from their respective maps, or at least indicate on the maps which patterns and/or groups are being used, in the event that entry cards are created but not sold or used for a game. Placing a bar code on the cards may facilitate this adjustment and may also be useful for confirming that cards claimed to be winning cards do in fact contain winning patterns and groups. Rather than representing the groups by letters, it may be more efficient to create a database which is a matrix having numbers of rows and columns equal to the numbers of patterns. Indicating whether a card exists can then be accomplished by placing a marker in the matrix or database in the correct position. Such a matrix might also simplify the comparisons needed to determine if a card exists having a pair of winning groups, as discussed below.

Control next passes to a block 118 where a number is selected as a winning number. The selection of numbers may be accomplished by any method, but will usually be selected randomly, as with balls in a hopper or by generation from a computer. The numbers are called out to the audience at a block 120 which, as previously discussed, may be done by a television, radio, in person or through any other communication system.

At a block 122 a winning number map is adjusted in accordance with the last selected number. The winning number map consists of all numbers which have been previously selected as winning numbers at the block 118. The winning number map may be a computer database or a written map may also be created.

At a block 124 the winning number map is compared to the map or maps of patterns to determine if any of the patterns are complete. A pattern is complete when all the symbols in that pattern have been selected as winning symbols. If no patterns are complete, there cannot be any winning entry cards, so another number must be drawn and control returns to the block 118. The above comparison assumes that a winning pattern is one in which all symbols in that pattern have been selected as winning patterns. It is also possible to use the present invention with a game in which a winning pattern is defined as less than a "complete" pattern, such as half of the symbols selected or nine out of ten, etc., or even some subpattern within the pattern itself.

If any patterns are complete, control then passes to a block 126 to determine if any patterns from another group are complete. If there exists only one complete pattern on the multi-group entry cards, there cannot be a complete card. If more than one complete pattern exists, it is possible that both those patterns are on one entry card. If, however, all the complete patterns are in one group, there can be no complete entry cards so that another symbol must be drawn and control passes once again to block 118.

If there are any patterns from the other group complete, then control passes to a block 128 to determine whether any cards exist with two complete groups. The determination in the block 128 is accomplished by comparing the group map created in the block 116 with a list of complete patterns which has been determined in the block 124. If there is no card with two complete groups, then another number must be selected and control passes once again to the block 118. If there are two complete groups, then control passes to a block 130, where it is announced that there is a winning entry. No more winning numbers are then selected, assuming that those running the game only wish to have one winning ticket. If more than one winning entry card is desired, additional numbers can be drawn and the comparisons of blocks 124, 126 and 128 undertaken until the desired number of winning entries exist.

The benefits of the above method can be seen by calculating the number of comparisons necessary to determine if a winning entry exists using the above method and comparisons necessary if each entry card must be compared. For instance, if it is desired to have one million entry cards with 25 spaces on each card, a minimum of 25 million comparisons might need to be undertaken as each symbol is drawn. Under some comparison scenarios, every symbol which has been drawn might need to be compared with every space after each drawing. So, if there are 25 spaces on an entry card and 30 symbols have been drawn, a total of 750 million comparisons would have to be made.

If, however, entry cards are created as described in FIG. 1 and the comparisons are made as described in FIG. 2, the number of comparisons is greatly reduced. If there are 1 million entry cards and the entry cards are divided into two groups each with 1,000 patterns where the first patterns has 10 symbols and the second pattern has 15 symbols, with each number drawn, there will be 10,000 comparisons with patterns made in group I and 15,000 comparisons with patterns made in group II for a total of 25,000 comparisons. If there are no complete patterns, than no additional comparisons need be undertaken. If there are complete patterns in each group, then a simple comparison of the group map, which will have 1 million entries but can be organized for easy comparison with the list of complete patterns, will need to be accomplished. If all entry cards created were sold, this last comparison might be eliminated because there must necessarily be a winning card in this instance. Thus, slightly over 25,000 comparisons would be necessary. If the numbers in the spaces are organized as they are in FIGS. 5 and 6, i.e., only numbers 1–15 in column 12, only numbers 16–30 in column 14, etc., then comparisons need only be made for the group or groups which contains the drawn number, further reducing the comparisons. If there have been 30 numbers selected, the numbers of comparisons goes up to only slightly over 750,000, which can still be accomplished in a short period of time by conventional personal computers. The method of the present invention, therefore, may reduce the amount of calculation time by approximately three orders of magnitude.

The above method for entry cards with two groups will also work with three or more groups. Having more groups will decrease the number of patterns and thus create a smaller map of patterns, but would make the group map more complex, complicating the comparison of block 128. If there are more than two groups, block 126 will require the determination of whether there are complete patterns for all groups. The method will also work where the cards have been assigned to different subsets each with different arrangements of groups. In such an instance, the comparisons of blocks 108, 110 and 112 will be undertaken for each subset of cards.

The above description has been discussed with regard to a bingo game in which a winning entry is an entry where all symbols in the spaces of the entry have been selected as winning symbols. It is possible, however, to use the above method where some subset of the spaces having winning symbols are considered winning cards, as for instance, four corners, one or more complete columns, all spaces on the outside of the entry card, diagonals or X's, etc. Such other winning configurations simply require the creation of groups which take into account those configurations and/or different definitions of when patterns are "complete" in block 124.

Figure 7:
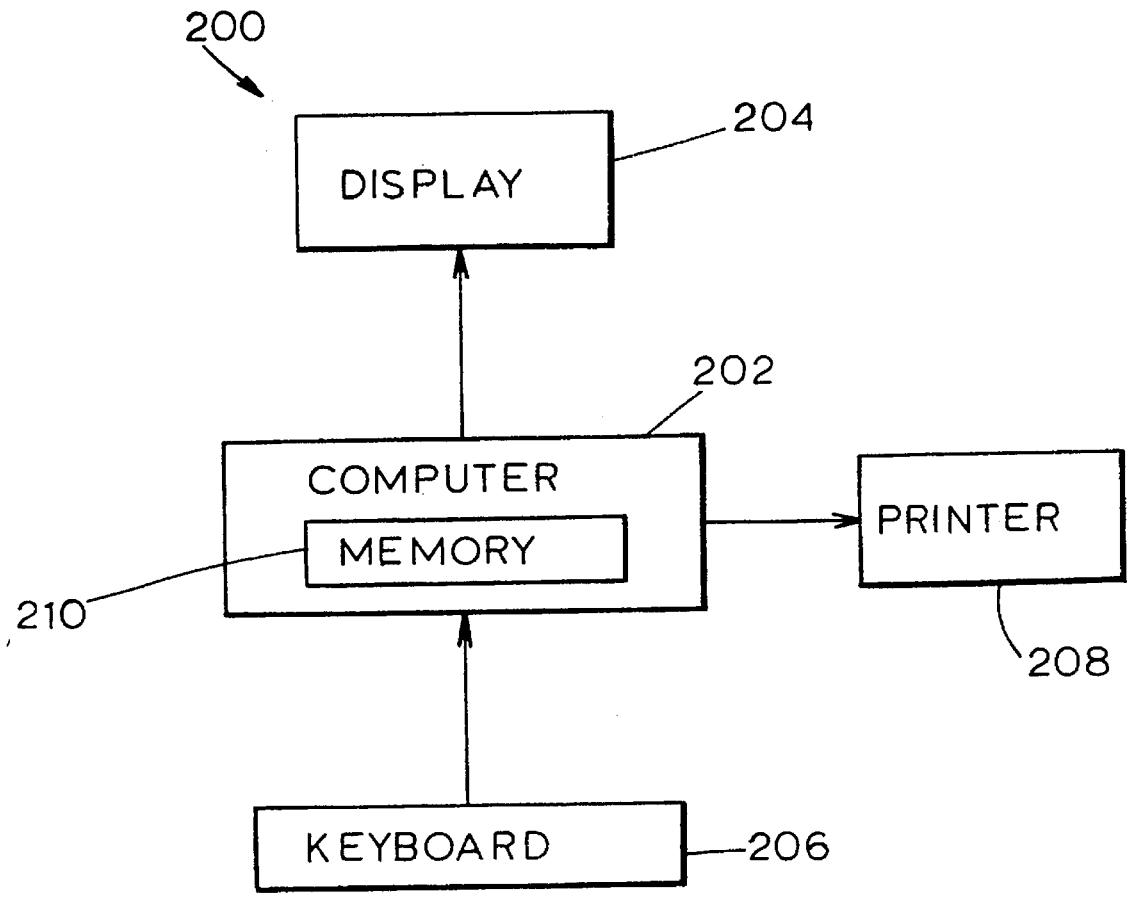
FIG. 7 is a block diagram of an apparatus capable of carrying out the method of the present invention.

Referring to FIG. 7, a computer system 200 which may incorporate the present invention includes a computer 202, a display 204, a keyboard 206, a printer 208, as well as a memory 210 within the computer 202. Additional input/output devices and other components may be included in the computer system 200 as desired or necessary. The computer system 200 may be used in the method described in connection with FIG. 1 for creating entry cards. In creating entry cards, the computer system 200 may incorporate a conventional lottery ticket creation and printing machine. The computer system 200 may also perform the winning ticket tracking described in connection with FIG. 2.

The foregoing detailed description has been given for clearness of understanding only and no unnecessary limitations should be understood therefrom as modifications will be apparent to those skilled in the art.

We claim:

1. A method for determining if a winning entry exists comprising the steps of:

creating entry cards comprising a plurality of spaces wherein each space contains one of a variety of symbols, the spaces are arranged in a first group and a second group, the symbols in the spaces of the first group on the cards form a first plurality of patterns and at least one of the patterns in the first plurality appears on more than one card, the symbols in the spaces of the second group on the cards form a second plurality of patterns, and a winning card comprises a first group with a winning pattern and a second group with a winning pattern;

creating a first map of all patterns in the first group and a second map of all patterns in the second group wherein the first map has fewer patterns than there are entry cards;

selecting a series of winning symbols;

creating a third map of winning symbols;

comparing the first map to the third map to determine whether any patterns in the first group are winning patterns; and comparing the second map to the third map to determine whether any patterns in the second group are winning patterns.

2. The method of claim 1 comprising:

creating a fourth map correlating which patterns in the first group appear on cards with which patterns in the second group; and comparing the fourth map to the winning patterns in the first group and the winning patterns in the second group to determine if there are any winning cards.

3. The method of claim 1 wherein patterns in the second group appear on more than one entry card and there are fewer patterns in the second map than there are entry cards.

4. The method of claim 1 wherein the second map is compared to the third map only if there are winning patterns in the first group.

5. The method of claim 4 wherein the fourth map is compared to the winning patterns in the first group and the winning patterns in the second group only if there are winning patterns in the second group.

6. The method of claim 5 wherein another symbol is selected and added to the third map if there are winning cards.

7. The method of claim 1 wherein the symbols comprise numbers or letters.

8. The method of claim 1 wherein:

the cards comprises columns of spaces;

the first group comprises a first column;

the second group comprises a second column;

a winning first group comprises symbols in the first column that have been selected as winning symbols; and a winning second group comprises symbols in the second column that have been selected as winning symbols.

9. The method of claim 1 wherein:

the cards comprise five columns of spaces;

the first group comprises a first and a second column;

the second group comprises a third column, a fourth column and a fifth column;

a winning first group comprises only symbols in the first column and the second column that have been selected as winning symbols; and a winning second group comprises only symbols in the third column, the fourth column and the fifth column that have been selected as winning symbols.

10. The method of claim 1 wherein the spaces of the cards are arranged in three or more groups and a winning entry card comprises a card having three or more groups with winning patterns.

11. The method of claim 1 wherein a winning pattern has only winning symbols.

12. A method for determining if a winning entry exists on entry cards comprising a plurality of spaces wherein each space contains one of a variety of symbols, the spaces are arranged in a first group and a second group, the symbols in the spaces of the first group on the cards form a plurality of patterns and at least one of the patterns in the first plurality appears on more than one card, the symbols in the spaces of the second group on the cards form a second plurality of patterns, and a winning card comprises a first group with a winning pattern and a second group with a winning pattern, comprising the steps of:

creating a first map of all patterns in the first group and a second map of all patterns in the second group wherein there are fewer patterns in the first map than there are entry cards;

selecting a series of winning symbols;

creating a third map of winning symbols;

comparing the first map to the third map to determine whether any patterns in the first group are winning patterns; and comparing the second may to the third map to determine whether any patterns in the second group are winning patterns.

13. The method of claim 12 comprising:

creating a fourth map correlating which patterns in the first group appear on cards with which patterns in the second group; and comparing the fourth map to the winning patterns in the first group and the winning patterns in the second group to determine if there are any winning cards;

wherein the second map is compared to the third map only if there are winning patterns in the first group, the fourth map is compared to the winning patterns in the first group and the winning patterns in the second group only if there are winning patterns in the second group, and another symbol is selected and added to the third map if there are no winning cards.

14. The method of claim 12 wherein:

the cards comprise five columns of spaces;

the first group comprises a first and a second column;

the second group comprises a third column, a fourth column and a fifth column;

a winning first group comprises only symbols in the first column and the second column that have been selected as winning symbols; and a winning second group comprises only symbols in the third column, the fourth column and the fifth column that have been selected as winning symbols.

15. The method of claim 12 wherein the spaces of the cards are arranged in three or more groups and a winning entry card comprises a card having three or more groups with winning patterns.

16. The method of claim 12 wherein a winning pattern has only winning symbols.

17. An apparatus for determining if a winning entry exists among a plurality of entry cards wherein the entry cards comprise a plurality of spaces, each space contains one of a variety of symbols, the spaces are arranged in a first group and a second group, the symbols in the spaces of the first group on the cards form a first plurality of patterns and at least one of the patterns in the first plurality appears on more than one card, the symbols in the spaces of the second group on the cards form a second plurality of patterns, and a winning card comprising a first group with a winning pattern and a second group with a winning pattern, comprising:

means for creating a first map of all patterns in the first group and a second map of all patterns in the second group wherein there are fewer patterns in the first map than there are entry cards;

means for selecting a series of winning symbols;

means for creating a third map of winning symbols;

means for comparing the first map to the third map to determine whether any patterns in the first group are winning patterns; and means for comparing the second map to the third map to determine whether any patterns in the second group are winning patterns.

18. The apparatus of claim 17 comprising:

means for creating a fourth map correlating which patterns in the first group appear on cards with which patterns in the second group; and means for comparing the fourth map to the winning patterns in the first group and the winning patterns in the second group to determine if there are any winning cards.

19. The apparatus of claim 17 wherein:

the second map is compared to the third map only if there are winning patterns in the first group;

the fourth map is compared to the winning patterns in the first group and the winning patterns in the second group only if there are winning patterns in the second group; and another symbol is selected and added to the third map if there are no winning cards.

* * * * *

UNITED STATES PATENT AND TRADEMARK OFFICE

CERTIFICATE OF CORRECTION

PATENT NO. : 5,577,727

DATED : November 26, 1996

INVENTOR(S) : Brame et al.

It is certified that error appears in the above-indentified patent and that said Letters Patent is hereby corrected as shown below:

Column 2, line 16, please delete "third" and insert --fourth--.
Column 2, line 20, please insert --third-- before the word "map".
Column 8, line 2, please insert --no-- before the word "winning".

Signed and Sealed this

Thirteenth Day of May, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,577,727

DATED : November 26, 1996

INVENTOR(S) : Ian G. Brame and Raymond K. Latham

It is certified that error appears in the above-indentified patent and that said Letters Patent is hereby corrected as shown below:

Column 2, line 16 of patent
please delete "third" and insert --fourth--.

Column 2, line 20 of patent
please insert --third-- before the word "map."

Claim 6, column 8, line 2 of the patent
insert --no-- before the word "winning."

Signed and Sealed this

Twenty-fourth Day of June, 1997

Bruce Lehman

*Attest:*

BRUCE LEHMAN

*Attesting Officer*

*Commissioner of Patents and Trademarks*